US006446372B1

(12) United States Patent
Reeves

(10) Patent No.: US 6,446,372 B1
(45) Date of Patent: Sep. 10, 2002

(54) MAGNETIC NAME PLATE ASSEMBLY

(75) Inventor: Robert J. Reeves, Attleboro, MA (US)

(73) Assignee: Reeves Company, Inc., Attleboro, MA (US)

( * ) Notice: Subject to any disclaimer, the term of this patent is extended or adjusted under 35 U.S.C. 154(b) by 0 days.

(21) Appl. No.: 09/575,756

(22) Filed: May 22, 2000

(51) Int. Cl.[7] ..... A44C 3/00

(52) U.S. Cl. ..... 40/66; 40/661.01; 40/600; 24/303

(58) Field of Search ..... 40/600, 661.01, 40/621, 1.6; 24/303, 66.1; 335/285

(56) References Cited

U.S. PATENT DOCUMENTS

| | | | |
|---|---|---|---|
| 4,236,331 | A | 12/1980 | Mattson |
| 5,369,899 | A | 12/1994 | Reeves |
| 5,504,976 | A | 4/1996 | Reeves |
| 6,006,455 | A | 12/1999 | Miller |

*Primary Examiner*—Cassandra H. Davis
(74) *Attorney, Agent, or Firm*—Salter & Michaelson

(57) ABSTRACT

A name plate assembly for use on a garment including a name plate and a connector which are magnetically attracted to each other, and which are disposed on opposite sides of a piece of clothing during use such that the clothing is sandwiched therebetween is provided. The name plate assembly is removed from the garment by the user pressing the connector through the fabric, or by otherwise engaging and applying a force to the connector such as by grasping and pulling on the connector. The connector acts as a lever when engaged in order to break the magnetic connection between the name plate and the connector, so that the name plate assembly may be easily removed from engagement with the article of clothing without excessive force.

In one embodiment, the connector is preferably V-shaped and includes an indentation on either end of the legs of the "V" in order to receive a magnet therein. The name plate preferably includes a face plate for displaying indicia, such as a user's name, and a back plate which is adapted to engage the garment and which is placed in a facing relationship to the magnets of the connector. The back plate is made of a magnetically conductive material such that the magnets of the connector are attracted to the back plate in order to hold the name plate assembly to the clothing. In one embodiment, the back plate includes a set of protrusions in order to limit movement of the connector and name plate relative to each other. The protrusions may also provide a guide for proper placement of the connector.

21 Claims, 5 Drawing Sheets

MAGNETIC NAME PLATE ASSEMBLY

DESCRIPTION

1. Technical Field

The invention relates generally to a name plate assembly, and more particularly to a name plate assembly which can be easily removed from a garment without injuring the garment or the user.

2. Background of Related Art

Magnetic name plates for use with clothing are known to the art. Such name plates generally operate by sandwiching a piece of clothing between two plates which are magnetically attracted to each other. For example, U.S. Pat. No. 5,369,899 which was invented by the applicant, discloses a name plate assembly including a flat, generally rectangular name plate (12) for mounting on the outer surface of the user's garment, and a complementary retaining member (14) for mounting on the inner side of the garment. The name plate and retaining member are magnetically received in a face-to-face relation so that the user's garment is sandwiched therebetween. The name plate and the retaining member are provided with interengaging elements that interlock with the fabric sandwiched therebetween in order to effectively limit the relative movement of the members relative to each other. In addition, the name plate and retaining member each include a ferrous steel plate (20, 36), respectively. The steel plates are positioned on opposite sides of a magnetic strip (30) in order to substantially increase the magnetic power of the magnetic strip thereby increasing the magnetic holding power between the name plate and the retaining member. While effective in adhering the name plate assembly to a an article of clothing, it can be difficult for a user to remove the assembly from the clothing. This is due in part to the flat, straight nature of the name plate and retaining member, and the superior magnetic holding power of the assembly, both of which require a user to pry the assembly apart in order to release it from engagement with the clothing.

Another magnetic name plate assembly is disclosed in U.S. Pat. No. 4,236,331 to Mattson. Mattson discloses a self-adhering name badge assembly (10) including a pair of separable flat badge panels (11, 12) which are designed to be placed in face-to-face relationship with a piece of clothing clamped therebetween, in order to support the assembly on the clothing. Each panel has a similar construction, including a magnetic core with N and S poles at opposite ends thereof, with the poles of one of the panels in complementary orientation relative to the poles of the other of the panels. The magnetic core and a ferromagnetic plate may be laminated together in order to increase the stiffness of the badge panels. While generally effective, it has been found that the badge panels can become easily detached from each other by simply brushing against the outer panel of the badge assembly, which causes the badge assembly to disengage from the garment.

Therefore, there is needed in the art a name plate assembly which can be effectively secured to a garment without inadvertently coming disengaged, and which is also easy for a user to remove when desired.

SUMMARY

One object of the present invention is to provide a magnetic name plate assembly which securely maintains the name plate to an article of clothing through magnetic attraction, and which can be easily removed from the garment by a user without injuring the garment or the user.

In accordance with one aspect, there is provided a name plate assembly for use on a garment having a name plate and a connector which are magnetically attracted to each other, and which are disposed on opposite sides of a piece of clothing during use such that the clothing is sandwiched therebetween. The name plate assembly is removed from the garment by the user pressing the connector through the fabric, or by otherwise engaging the connector, for example by grasping and pulling on the connector, the connector acting as a lever in order to break the magnetic connection between the name plate and the connector so that the name plate assembly may be easily removed from engagement with the article of clothing without excessive force.

In one embodiment, the connector is preferably V-shaped and includes an indentation on either end of the legs of the "V" in order to receive a magnet therein. The connector is preferably made of a conductive material such that the magnets can be held in place within the connector by magnetic attraction, without the need for adhesives or the like. The name plate preferably includes a face plate for displaying indicia, such as a user's name, and a back plate which is adapted to engage the garment and which is placed in a facing relationship to the magnets of the connector. The back plate is made of a magnetically conductive material such that the magnets of the connector are attracted to the back plate in order to hold the name plate assembly to the clothing. In one embodiment, the back plate includes a set of protrusions in order to limit movement of the connector and name plate relative to each other. The protrusions may also provide a guide for proper placement of the connector.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A magnetic name plate assembly 10 for attachment to an article of clothing according to one embodiment of the present invention is illustrated in FIGS. 1–9. The name plate assembly 10 preferably includes a name plate 12 and a connector 14 which are magnetically attracted to each other, and which are disposed on opposite sides of a piece of clothing during use such that the clothing is sandwiched therebetween.

Figure 1:
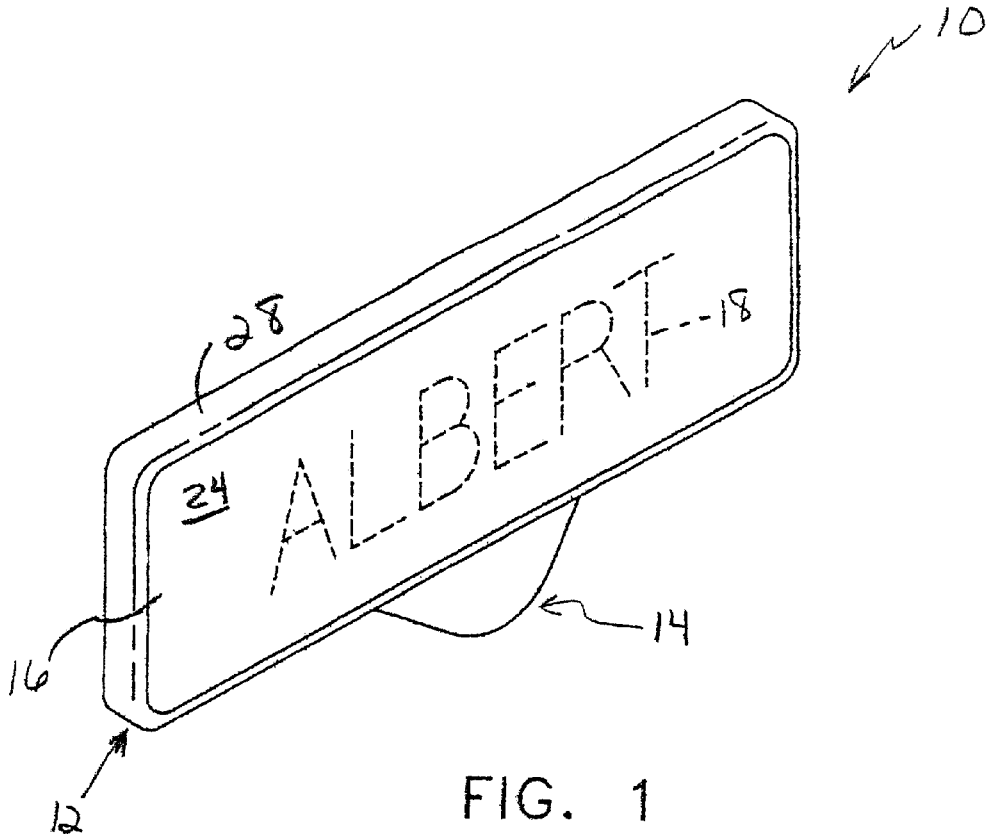
FIG. 1 is a front perspective view showing a magnetic name plate assembly in accordance with one embodiment of the present invention.
Figure 2:
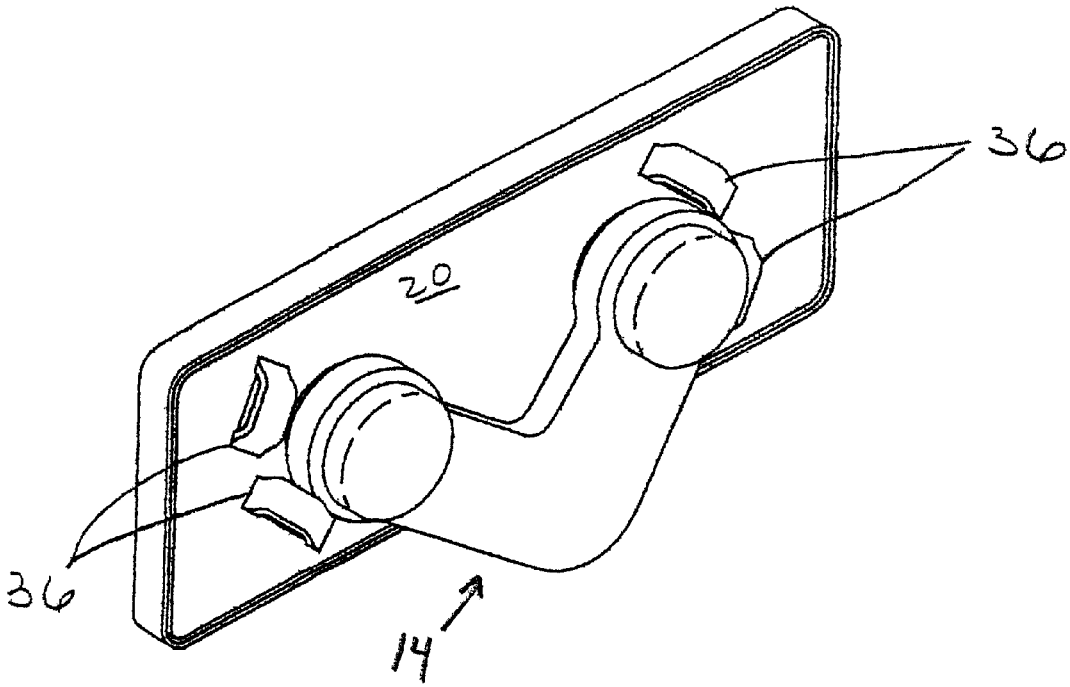
FIG. 2 is a rear perspective view of the name plate assembly of FIG. 1 with the name plate and connector in engagement.
Figure 3:
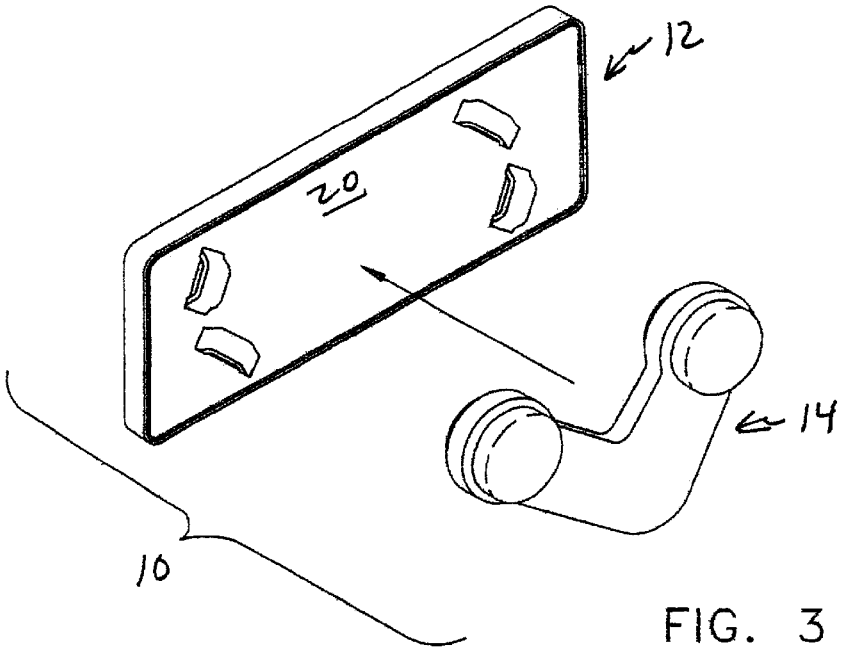
FIG. 3 is a rear view of the name plate assembly of FIG. 1 with the name plate and connector disengaged.
Figure 4:
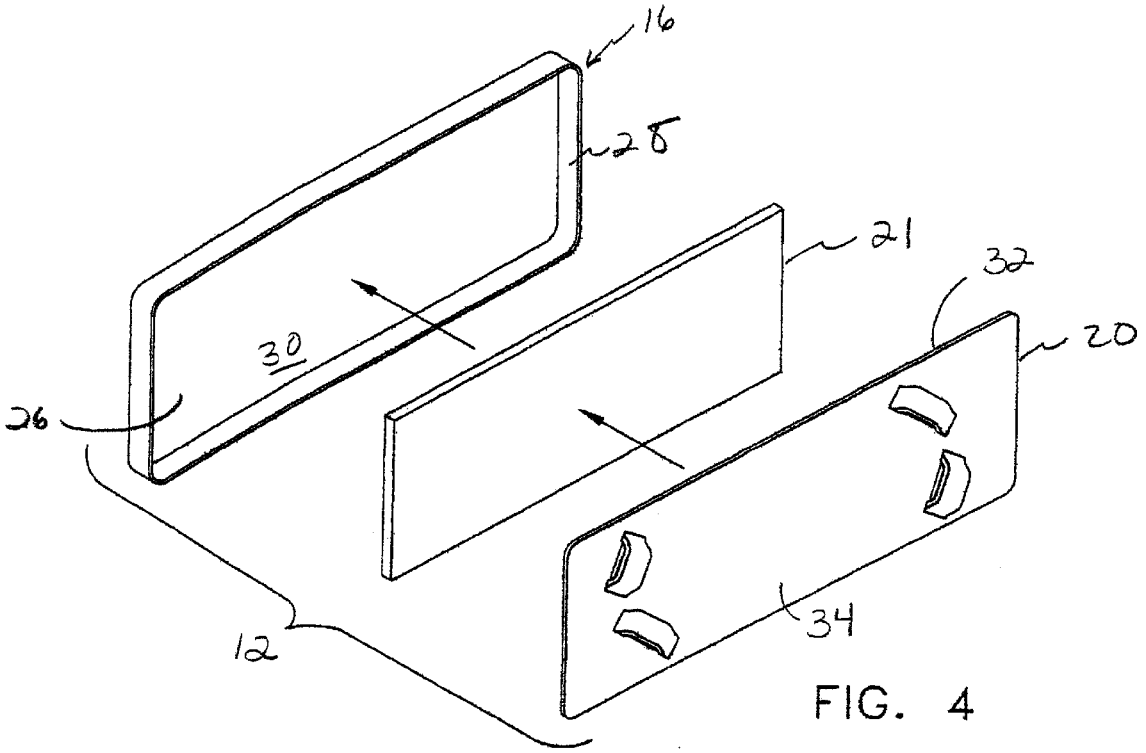
FIG. 4 is an exploded view of the name plate assembly of FIG. 1.
Figure 5:
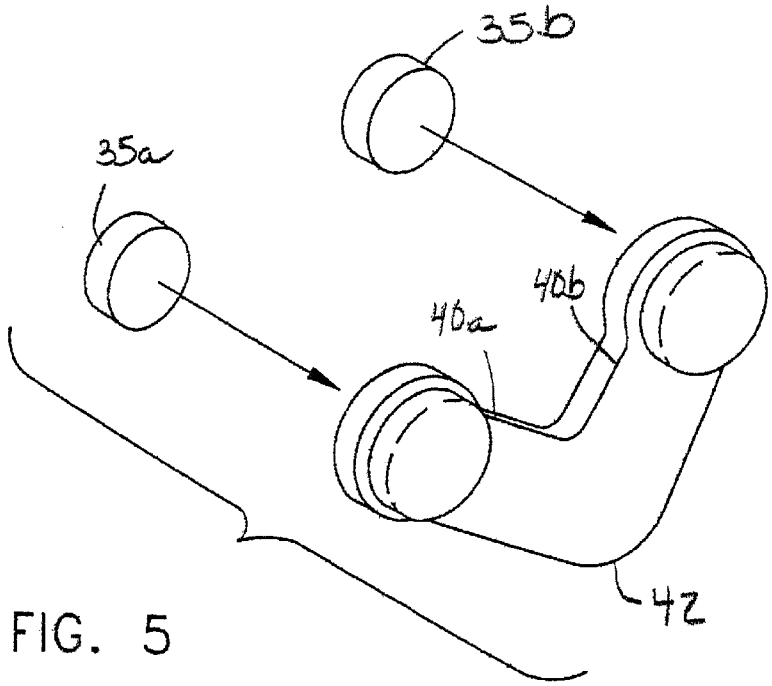
FIG. 5 is a perspective view of the connector of the name plate assembly of FIG. 1 with magnets removed.
Figure 6:
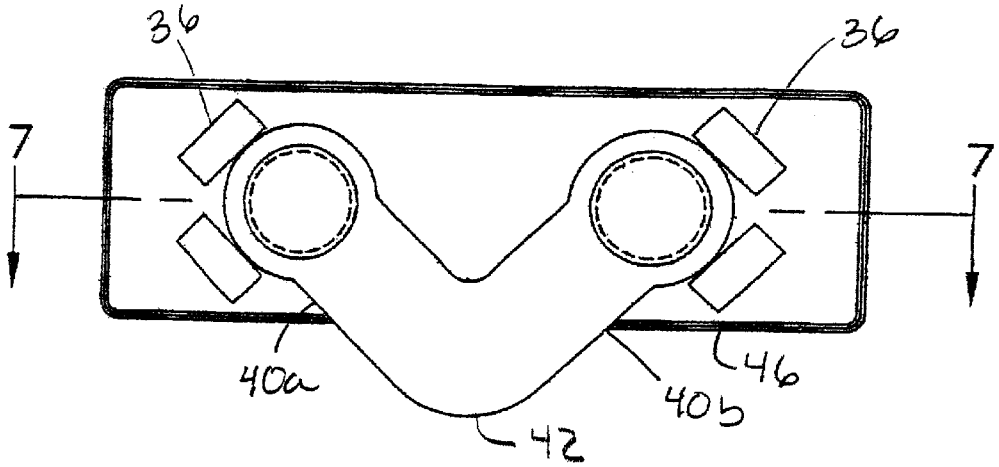
FIG. 6 is a rear plan view of the name plate assembly of FIG. 1 with the name plate and connector in engagement.
Figure 7:
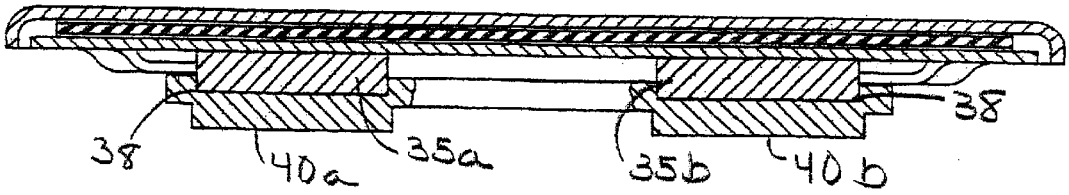
FIG. 7 is a cross-sectional view of the name plate assembly of FIG. 1 taken along lines 7—7 of FIG. 6.
Figure 8:
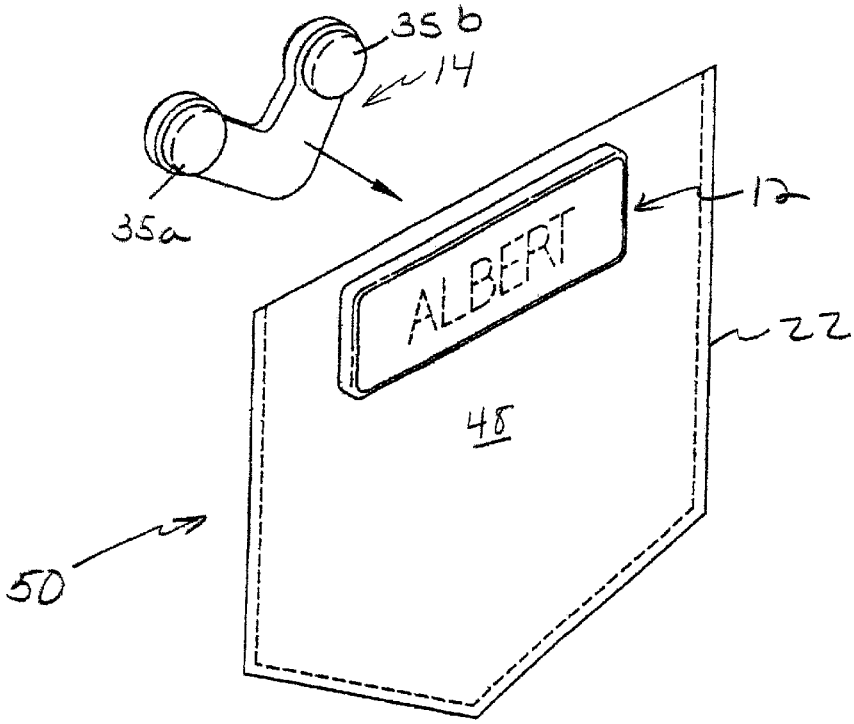
FIG. 8 is a perspective view showing the name plate assembly being engaged with an article of clothing.
Figure 9:
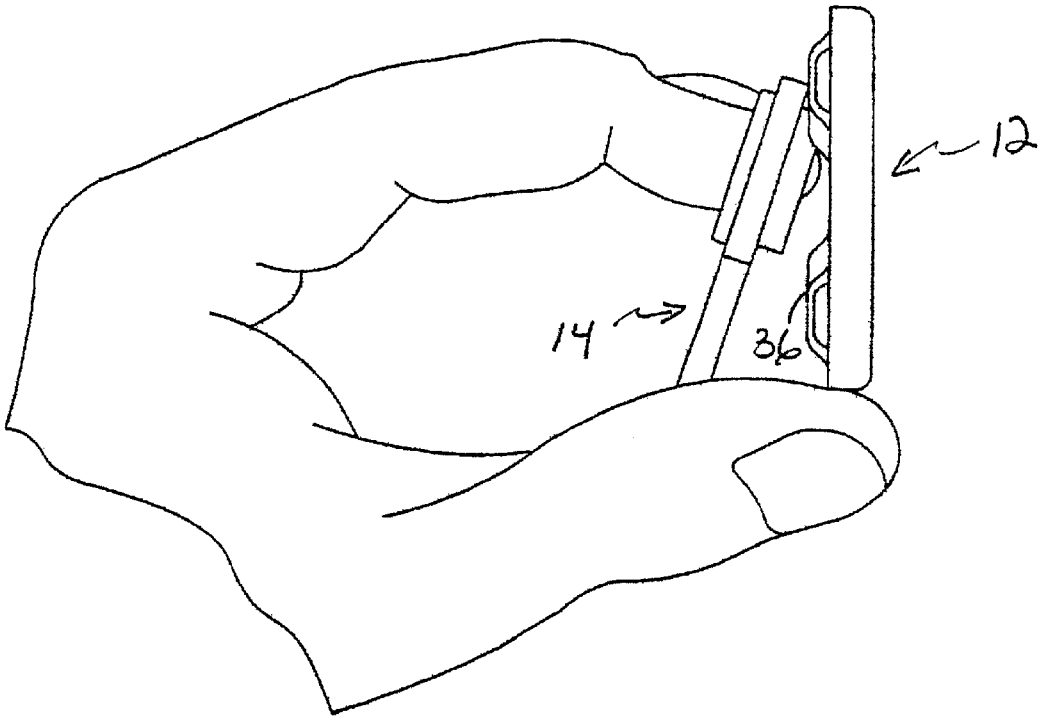
FIG. 9 is a schematic view showing the connector being removed from engagement with the name plate by a user.

The name plate preferably includes a face plate 16 for displaying indicia, such as a user's name 18, and a back plate 20 which is adapted to engage the article of clothing 22 (FIG. 8). The face plate 16 may be attached to the back plate 20 by adhesive, for example a strip of double sided adhesive tape 21. In the present embodiment, the face plate preferably includes a front surface 24 and a rear surface 26, with a lip 28 extending from the front surface and around a perimeter of the face plate. The lip defines a recess 30 for receiving the adhesive tape 21 and back plate 20 therein (FIG. 4). The back plate 20 is sized to fit within recess 30 and includes a first surface 32 for connection to the face plate by the adhesive, and a second or rear surface 34 adapted to engage the article of clothing 22. The rear surface of the back plate 20 is placed in a facing relationship with the connector 14 during use, such that the article of clothing is sandwiched between the back plate and the connector 14. The back plate 20 is preferably made of a magnetically conductive material such that magnets 35*a, b* disposed in connector 14 are attracted to the back plate 20 in order to hold the name plate assembly to the clothing. The back plate may also preferably include a set of protrusions 36 in order to limit movement of the name plate assembly and connector 14 relative to each other, as described in greater detail below. In the present embodiment, the face plate 16 and back plate 20 are preferably generally flat and rectangular in shape, although other shapes, sizes and configurations may be utilized as would be known to one of skill in the art. In addition, although shown as separate pieces, the name plate 12 may be formed as a single, unitary member.

Connector 14 is preferably V-shaped, including a pair of legs 40*a, b* and an apex 42 connecting the legs. When the name plate assembly is attached to the article of clothing during use, the apex of the connector preferably extends below a lower edge 46 of the name plate assembly. When the apex 42 is engaged by the user, such as by pushing or pulling, the connector 14 acts as a lever in order to disengage the connector 14 from the name plate 12, as described in greater detail below. The connector may also preferably include a pair of indentations 38 (FIG. 7) in a first side 39 of the connector, the indentations being disposed on either end of legs 40*a, b* in order to receive magnets 35*a, b* therein. The first side containing the magnets is preferably disposed in facing relation with the back plate during use such that the article of clothing is sandwiched therebetween, and the name plate is secured in place by the magnetic attraction between the magnets and the back plate.

The connector 14 may preferably be made of a conductive material, such as metal, so that the magnets 35*a, b* can be held in place by magnetic attraction, without the need for adhesives or the like. In order to prevent the magnets from falling out of the indentations, the conductive material from which the connector 14 is made is preferably sufficiently thicker than that of the back plate 20 to which the magnets are magnetically attracted, since the strength of magnetic attraction is directly related to the mass, or thickness, of the conductive material. The connector may preferably be about 25% (or more) thicker than the thickness of the backplate, and is most preferably about 33% thicker than that of the back plate, such that the back plate is sufficient to hold the name plate assembly firmly, but does not have enough attraction to pull the magnets out of the connector. In the present embodiment, the connector is made from 0.074 steel, while 0.025 steel is used for the back plate. Alternatively, the connector 14 may be made out of any material, and the magnets 35*a, b* may be held in place by adhesive or other mechanical connection. In the present embodiment, two circular-shaped magnets 35*a, b* are preferably provided although other shapes and number of magnets may be utilized, as would be known to one of skill in the art.

Use of the magnetic name plate assembly will now be described with continued reference to FIGS. 1–9.

In use, the user places the name plate 12 on an outer surface 48 of the article of clothing 22, for example pocket 50 (FIG. 8), such that the back plate engages the clothing's outer surface, and the face plate faces outward. The user then places the connector 14 against the inside surface of the clothing such that magnets 35*a, b* engage the clothing's inner surface and are in facing relationship with the back plate. In this manner, part of the clothing is sandwiched between the name plate and connector in order to securely maintain the name plate to the clothing. The magnets 35*a, b* are preferably placed such that they lie between protrusions 36 which act as a stop in order to limit movement of the name plate assembly and connector 14 relative to each other, and to provide a guide for proper placement of the connector. In the present embodiment, there are two sets of two generally rectangular protrusions each, although the number and size of the protrusions may vary, or there may be no protrusions. Once the name plate and connector are properly positioned, the magnetic force between the magnets disposed in the connector and the back plate operates to securely maintain the name plate assembly to the article of clothing.

In order to remove the name plate assembly, the user may press on the apex of the connector 14 through the fabric, may grasp and pull on the connector, may place their finger beneath the apex and push on the connector while holding the connector (FIG. 9), or may otherwise engage and apply a force to the apex of the connector. In any case, the connector acts as a lever in order to break the magnetic connection between the name plate and the connector so that the name plate assembly may be easily removed from engagement with the article of clothing without excessive force. In this manner, the name plate assembly can be easily removed by the user without injuring the article of clothing, or the user (for example the user's finger or nail).

It will be understood that various modifications may be made to the embodiment disclosed herein. For example, the shape, size and dimension of the elements described herein are not to be construed as limiting, but only as examples, as would be known to one of skill in the art. In addition, the connector may have an alternate shape, as long as the connector is capable of acting as a lever in order to break the magnetic connection between the connector and the name plate. The elements described herein may also be made of a variety of materials, provided that the connector is magnetically attracted to the back plate in order to hold the name plate assembly in engagement with the article of clothing, for example, the back plate may include a magnet in addition to, or instead of the connector. Therefore, the above description should not be construed as limiting, but merely as exemplifications of a preferred embodiment. Those skilled in the art will envision other modifications within the scope spirit of the invention.

What is claimed is:

1. A magnetic name plate assembly for attachment to an article of clothing comprising:

a name plate including a front surface adapted to display indicia, and a rear surface adapted to contact an outer portion of the clothing;

a connector including a first side adapted to contact an inner portion of the clothing such that a portion of the clothing is sandwiched between the name plate and connector during use, a first portion of the connector extending beyond an edge of the name plate, the first portion having a size sufficient to be gripped by the fingers of a user, the connector further including a second portion, adjacent the name plate;

wherein at least the connector or the name plate includes a magnetic member such that the connector and name plate are held in magnetic engagement during use; and wherein to disengage the connector from the name plate, a user applies a sufficient force to the first portion of the connector, so as to pivot the connector about the second portion, the connector acting as a lever and the name plate acting as a fulcrum to produce a force sufficient to disengage the connector from magnetic engagement with the name plate.

2. The name plate assembly of claim 1, wherein the connector is generally V-shaped, including a first and a second leg, and an apex connecting the first and second legs.

3. The name plate assembly of claim 2, wherein the apex of the connector extends below the lower edge of the name plate and the user applies the force to the apex.

4. The name plate assembly of claim 1, wherein the magnetic member comprises a magnet and the connector includes an indentation for holding the magnet therein.

5. The name plate assembly of claim 1, wherein the name plate includes a front plate including a lip defining a recess, and a back plate constructed and arranged to fit within the recess.

6. The name plate assembly of claim 5, wherein the back plate is placed in facing relationship with the connector during use.

7. The name plate assembly of claim 5, wherein the back plate is made from a magnetically attractive material.

8. The name plate assembly of claim 5, wherein the back plate includes at least one protrusion constructed and arranged to limit the movement of the connector when the connector is magnetically engaged therewith.

9. The name plate assembly of claim 5, wherein the connector has a thickness greater than that of the base plate.

10. The name plate assembly of claim 1, wherein the name plate is formed as a unitary piece.

11. A magnetic name plate assembly for attachment to an article of clothing comprising:

a name plate including a front surface adapted to display indicia, and a rear surface adapted to contact an outer portion of the clothing;

a connector constructed and arranged to be held in magnetic engagement with the name plate such that a portion of the clothing is sandwiched between the name plate and connector, the connector being generally V-shaped and including a first and a second leg, and an apex connecting the first and second legs, the apex of the connector extending below a lower edge of the name plate during use;

wherein to disengage the connector from magnetic engagement with the name plate, a user applies a sufficient force to the apex of the connector such that the connector acts as a lever in order to break the magnetic attraction between the name plate and connector.

12. The name plate assembly of claim 11, wherein the connector includes an indentation for holding a magnet therein.

13. The name plate assembly of claim 11, wherein the name plate includes a front plate and a back plate.

14. The name plate assembly of claim 13, wherein the back plate is placed in facing relationship with the connector during use.

15. The name plate assembly of claim 13, wherein the back plate is made from a magnetically attractive material.

16. The name plate assembly of claim 13, wherein the back plate includes at least one protrusion constructed and arranged to limit the movement of the connector when the connector is magnetically engaged therewith.

17. The name plate assembly of claim 13, wherein the connector has a thickness greater than that of the back plate.

18. The name plate assembly of claim 11, wherein the name plate is formed as a unitary piece.

19. A method of attaching a magnetic name plate assembly to an article of clothing comprising the steps of:

providing a name plate and a connector which are magnetically attracted to each other;

placing the name plate in contact with an outer portion of the clothing;

placing the connector in contact with an inner portion of the clothing and in facing relationship to the name plate such that the connector is held in magnetic engagement with the name plate, and a first portion of the connector extends beyond an edge of the name plate, the first portion having a size sufficient to be gripped by the fingers of a user;

grasping the first portion of the connector with sufficient force, and pivoting the connector about a point such that the connector acts as a lever and the name plate acts as a fulcrum in order to break the magnetic connection between the name plate and the connector, so that the name plate assembly may be easily removed from engagement with the article of clothing without excessive force.

20. The method of claim 19, wherein a user engages the lower edge of the connector through the article of clothing in order to apply the sufficient force to the connector.

21. The method of claim 19, wherein the connector is generally V-shaped, including a first leg and a second leg connected by an apex, the apex extending below the lower edge of the name plate.

* * * * *